US011331232B1

(12) United States Patent
Glover

(10) Patent No.: US 11,331,232 B1
(45) Date of Patent: May 17, 2022

(54) WHEELCHAIR IMPROVEMENT KIT AND MANUAL WHEELCHAIR

(71) Applicant: Marvin Joseph Glover, Amherst, MA (US)

(72) Inventor: Marvin Joseph Glover, Amherst, MA (US)

(73) Assignee: Marvin Joseph Glover, Amherst, MA (US)

( * ) Notice: Subject to any disclaimer, the term of this patent is extended or adjusted under 35 U.S.C. 154(b) by 0 days.

(21) Appl. No.: 17/537,996

(22) Filed: Nov. 30, 2021

(51) Int. Cl.
*A61G 5/10* (2006.01)
*A61G 5/12* (2006.01)

(52) U.S. Cl.
CPC ..... *A61G 5/1089* (2016.11); *A61G 5/104* (2013.01); *A61G 5/1035* (2013.01); *A61G 5/122* (2016.11)

(58) Field of Classification Search
CPC ..... A61G 5/1035; A61G 5/104; A61G 5/122; A61G 5/1089
USPC ..... 280/250.1
See application file for complete search history.

(56) References Cited

U.S. PATENT DOCUMENTS 3,288,250 A * 11/1966 Oja ..... A61G 5/1029 188/5
3,759,544 A * 9/1973 Korpela ..... A61G 5/10 5/503.1
4,544,200 A 10/1985 Dunn
4,759,561 A 7/1988 Janssen
5,044,647 A 9/1991 Patterson
5,178,025 A 1/1993 Bennett
5,181,733 A 1/1993 Tague
5,195,803 A 3/1993 Quintile
(Continued)

FOREIGN PATENT DOCUMENTS

CA 2097644 A1 12/1994
DE 2259383 6/1974
(Continued)

OTHER PUBLICATIONS

1287804, EP, A2, Mar. 5, 2003, Yamasaki Ryuji, The patent relates to a reclinable wheelchair which allows a seated user to adjust the inclination angle of a seat back rest.
(Continued)

*Primary Examiner* — Kevin Hurley
*Assistant Examiner* — Felicia L. Brittman
(74) *Attorney, Agent, or Firm* — Jing Wang

(57) ABSTRACT

The present invention relates to a wheelchair improvement kit and a manual wheelchair. The improvement kit includes an anti-tip device including a pair of multifunction tube assemblies. Each multifunction tube assembly includes a mount tube configured for pivotally mounting one on each side of the wheelchair, a slide tube slidably engaged to the mount tube where both ends of the slide tube extend beyond the mount tube, a slide tube brake engaging or releasing the position of the slide tube relative to the mount tube, and an extendable pole inserted into the top of the slide tube. The top of the extendable pole is fitted with a hand grip. The anti-tip device further includes a pair of guide tubes configured for mounting one on each side of the wheelchair. When the multifunction tube assembly is used as the anti-tip device, the slide tube passes through the guide tube.

25 Claims, 8 Drawing Sheets

(56) References Cited

U.S. PATENT DOCUMENTS

| | | | | |
|---|---|---|---|---|
| 5,241,876 | A * | 9/1993 | Mathis | A61G 5/025 135/66 |
| 5,292,144 | A | 3/1994 | Sosnoff | |
| 5,297,021 | A | 3/1994 | Koerlin | |
| 5,366,036 | A | 11/1994 | Perry | |
| 5,513,867 | A | 5/1996 | Bloswick | |
| 5,823,621 | A | 10/1998 | Broadhead | |
| 5,865,504 | A | 2/1999 | Warhaftig | |
| 5,918,936 | A | 7/1999 | Murphy | |
| 6,048,031 | A | 4/2000 | Warhaftig | |
| 6,105,731 | A * | 8/2000 | Du Rees | A61G 5/10 188/2 F |
| 6,113,189 | A | 9/2000 | Bennett et al. | |
| 6,206,393 | B1 | 3/2001 | Mascarl | |
| 6,224,156 | B1 | 5/2001 | Fleigle | |
| 6,276,704 | B1 | 8/2001 | Suiter | |
| 6,409,265 | B1 | 6/2002 | Koerlin | |
| 6,425,635 | B1 | 6/2002 | Pulver | |
| 6,494,474 | B1 | 12/2002 | Kramer, Jr. | |
| 6,533,358 | B1 | 3/2003 | Avihod | |
| 7,097,189 | B2 | 8/2006 | Hsu | |
| 7,306,251 | B2 | 12/2007 | Bright | |
| 7,669,863 | B2 | 3/2010 | Steiner | |
| 8,297,641 | B2 | 10/2012 | Landry | |
| 8,322,741 | B2 | 12/2012 | Laslo | |
| 8,360,518 | B2 | 1/2013 | Braaten | |
| 8,985,618 | B2 | 3/2015 | Perk | |
| 9,907,713 | B2 | 3/2018 | Dahlin | |
| 9,907,723 | B2 | 3/2018 | Bisceglia | |
| D834,459 | S | 11/2018 | Wang | |
| 10,238,558 | B2 | 3/2019 | Kramer | |
| 10,744,051 | B2 * | 8/2020 | Virgo | A45B 7/00 |
| 2002/0175027 | A1 | 11/2002 | Usherovich | |
| 2003/0042779 | A1 | 3/2003 | Yamasaki | |
| 2004/0046358 | A1 | 3/2004 | White et al. | |
| 2004/0222611 | A1 | 11/2004 | Fenwick | |
| 2015/0290056 | A1 * | 10/2015 | Derringer | A61G 5/101 280/755 |

FOREIGN PATENT DOCUMENTS

| | | | |
|---|---|---|---|
| EP | 1287802 | A2 | 3/2003 |
| GB | 1350123 | | 4/1974 |
| JP | 8112315 | A | 5/1996 |
| JP | 2001333938 | A | 12/2001 |
| WO | 2004096620 | A1 | 11/2004 |

OTHER PUBLICATIONS

8112315, JP, A, May 7, 1996, Tsiziki, The patent relates to a walking stick holder for a wheelchair.

2001333938, JP, A, Dec. 4, 2001, The patent application relates to a wheelchair used by a physically handicapped patient, and particularly when the patient is moved from bed to wheelchair or from wheelchair to bed with the assistance of a caregiver.

2004096620, WO, A1, Nov. 11, 2004, Todd A. Kuiken, The patent application relates to a wheelchair that is capable of shifting an occupant from a sitting position to a standing position, and of allowing the occupant to move himself or herself in the sitting position, the standing position, or in any position in between.

1350123, GB, Apr. 18, 1974, Oy Sucmen Vanutehdas-Finnwad Ltd, The patent relates to a wheelchair which includes a handrail supported at one end by the wheelchair and at the other end, during use thereof, by an external support.

2259383, DE, A1, Jun. 12, 1974, Universal und Trainingsgerat fur Rollstuhlbenutze, The patent relates to a wheelchair, which gives disabled person opportunity to stand without outside help.

* cited by examiner

WHEELCHAIR IMPROVEMENT KIT AND MANUAL WHEELCHAIR

CROSS REFERENCES TO RELATED APPLICATIONS

This application claims the benefits of priority from U.S. Provisional Patent Applications No. 63/199,011 filed Dec. 1, 2020 and No. 63/238,143 filed Aug. 28, 2021, which are hereby incorporated by references in their entirety, with any definitions of terms in the present application controlling.

BACKGROUND

This invention relates to an improvement kit for manual wheelchairs and to a manual wheelchair, providing a user controlled anti-tip device, and additional features.

The primary objective of this invention is to enhance a wheelchair user's ability to safely and securely move about, making the user inwardly more confident and outwardly less reliant on caregivers.

One of the biggest insecurities that wheelchair users face is that the wheelchairs are prone to falling over backwards. Anti-tip devices are commercially available for various types of manual wheelchairs to reduce this hazard. Typically, the anti-tip devices are installed as a pair, one behind each rear wheel of the wheelchair, with the anti-tip device extending rearwards from a lower horizontal frame tube and terminating in wheels or a non-skid cap at some height and rearward extension behind the rear wheel axles so as to contact the ground at a corresponding tipping angle of the wheelchair.

The problem with most conventional wheelchair anti-tip devices is that the setting of the tipping angle, a combination of height and rearward extension of the anti-tip device termination, is either not adjustable or can only be readily adjusted from behind the wheelchair. It is difficult for a seated user to reach down to change a setting first on one side then on the other, and even a caregiver behind the wheelchair must stoop or bend over to set such adjustable anti-tip devices. A lower tipping angle setting sufficient for going over doorway thresholds would not allow the wheelchair to tip back enough for the front wheels to clear a higher obstruction. A higher tipping angle setting, however, increases risk of the user accidentally upending the wheelchair. Because the conventional anti-tip devices are difficult to adjust, they are typically left at a high setting, for sake of convenience. Keeping the anti-devices high, however, increases the risk of the wheelchair tipping over.

U.S. Pat. No. 5,181,733 provides an anti-tipping device for a wheelchair. The device is arranged so that a knob or lever adjacent the foot of the wheelchair user can be turned to rotate the anti-tipping bar to its useful position. However, this anti-tipping device provides only an "on-off" rather than a range of height settings of the anti-tipping device.

Commercial manual wheelchairs with reclining backrests include a backrest brake and brake control. The brake control is typically located behind the backrest where it is out of the seated wheelchair user's reach. Thus, it requires a caregiver to operate the backrest brake and guide the backrest to its new position from behind the wheelchair.

EP1287802A2 describes a reclinable wheelchair which allows a user to adjust the inclination angle of the backrest by having actuators to drive the seat backrest and capable of holding the seat backrest at an arbitrary position between the upright position and the inclined position. A reclining lever is arranged within reach of the seated user to manipulate the actuators.

U.S. Pat. No. 5,513,867 describes a seat-lift wheelchair in which a seat pivots forward to assist the user getting in and out of the wheelchair. The seat is biased toward its forward or up-right position by mechanical springs. The springs have force adjustment for user adjustment of the seat-lift force.

U.S. Pat. No. 5,178,025 describes a tiltable lift seat device which includes a pivotably mounted energy storage device and a parallelogram linkage between the seat base and a chair seat for controlling elevation and tilting motion of the seat. Provision of similar useful functionality with minimal added complexity would be a helpful option.

For wheelchair users unable to leave the wheelchair for toiletry, a seat elevation device that helps raise the seated wheelchair user to allow a bedpan to be inserted beneath the seat provides convenience for the user and reduces physical, financial, and emotional burdens on both the user and the caregiver.

CA02097644 describes a body lifting apparatus for a wheelchair. The wheelchair has a seat secured to the wheelchair, a frame for supporting the seat, a body support to be carried by the frame, and movement transmission to be secured to the frame and operable to move the body support and the seat relative to each other. The operation of the movement transmission moves a person seated on the seat, off the seat, thereby leaving a space between the body support and the seat. For the physically disabled wheelchair users, a simple and inexpensive means of providing vertical seat lift force would be a helpful option.

Wheelchair users with severe physical handicaps tend to stay passively in their wheelchairs for extended periods of time. Long term immobility is associated with discomfort and morbidity. Wheelchairs or wheelchair attachments having features that enable users to change position for better comfort, to improve mobility, or to make routine actions easier would be useful.

GB1,350,123 describes a wheelchair including a pair of handrails supported at one end by said wheelchair and at the other end, during use thereof, by an external support. The handrail is free to pivot in all directions and the free end extended to rest on a table or the ground. Furthermore, the handrails are detachable from the wheelchair to be used as walking sticks or crutches. In general, the handrails help the wheelchair user to get out and get into the wheelchair, give the user opportunity for ample exercise, and for independent actions without outside help.

DE2259383A1 describes a universal and training device for wheelchairs, which gives disabled person opportunity to stand without outside help. The body of the disabled person may find necessary support through a seat, knee straps, and through a chest support. Bars of the universal and training device may be inserted separately into the armrests for serving as wheelchair supports when the tilted wheelchair is used as a deck chair.

Providing a wheelchair improvement kit that enables addition of these or similar features to wheelchairs common in the marketplace would benefit many wheelchair users. Combining multiple desired features into one wheelchair in a way that does not result in an unwieldy and complicated device would also benefit many wheelchair users.

SUMMARY

One aspect of the present invention provides a wheelchair improvement kit installable to many commercial manual wheelchairs, with some features specific to reclining backrest wheelchairs. The improvement kit includes an anti-tip device, which includes a pair of multifunction tube assemblies configured for mounting one on each side of the wheelchair. Each multifunction tube assembly includes a mount tube configured for pivotally mounting on a side of the wheelchair, a slide tube slidably engaged with the mount tube, a slide tube brake engaging or releasing a position of the slide tube relative to the mount tube, and an extendable pole inserted into the top of the slide tube. The top of the extendable pole is fitted with a hand grip. The mount tube is rotatable in a vertical plane parallel to the side of the wheelchair. The upper and lower ends of the slide tube extend beyond the mount tube. The wheelchair improvement kit further includes a pair of guide tubes configured for mounting one on each side of the wheelchair and positioned below the mount tubes. When the multifunction tube assembly functions as the anti-tip device, the mount tube is oriented diagonally upward towards the front of the wheelchair and the slide tubes pass through the guide tubes. The height of the lower end of the slide tube above the ground is adjustable by releasing the slide tube brake, sliding the slide tube to set the height of its lower end, and reengaging the slide tube brake.

A second aspect of the present invention provides a novel manual wheelchair with selected features disclosed in the wheelchair improvement kit. The novel manual wheelchair includes a wheelchair frame, a seat, a backrest, a plurality of wheels, and an anti-tip device. The anti-tip device includes a pair of the multifunction tube assemblies mounted one on each side of the wheelchair, a pair of the guide tubes mounted one on each side of the wheelchair below the mount tube of the corresponding multifunction tube assembly, and a kick plate mounted on the wheelchair frame to the rear of the wheelchair rear wheel axles and to the rear of the guide tubes. When the multifunction tube assembly functions as the anti-tip device, the mount tubes are oriented diagonally upward towards the front of the wheelchair and the slide tubes pass through the guide tubes.

For the case of a reclining backrest wheelchair, additional features of the novel manual wheelchair include positioning of the backrest brake controls within reach of the seated wheelchair user and provision of a counterbalancing torque to the backrest when the backrest brake control releases the backrest brake, which enables the wheelchair user to raise and lower the backrest without a caregiver's assistance. Description of embodiments of the invention in relation to the novel manual wheelchair may be referenced from the descriptions of corresponding parts in the wheelchair improvement kit.

Other aspects of the present invention can be understood by professionals skilled in the art in light of the detailed patent description, the claims, and the drawings of the present invention.

BRIEF DESCRIPTION OF THE DRAWINGS

The following drawings are merely for illustrative purposes according to various embodiments and are not intended to limit the scope of the present invention.

DETAILED DESCRIPTION

Reference will be made in detail to exemplary embodiments of the invention, which are illustrated in the accompanying drawings. Wherever possible, the same reference numbers will be used throughout the drawings to refer to the same or like parts.

Figures illustrate schematic structures of exemplary components in the wheelchair improvement kit, schematic assembly of the right and left multifunction tube assemblies 200 and 202 and other devices, installation methods of the components of the wheelchair improvement kit to the manual wheelchair, as well as the novel manual wheelchair according to various embodiments of the present invention. The advantages, features, and benefits of the present invention will become apparent from the drawings and specifications.

Figure 1:
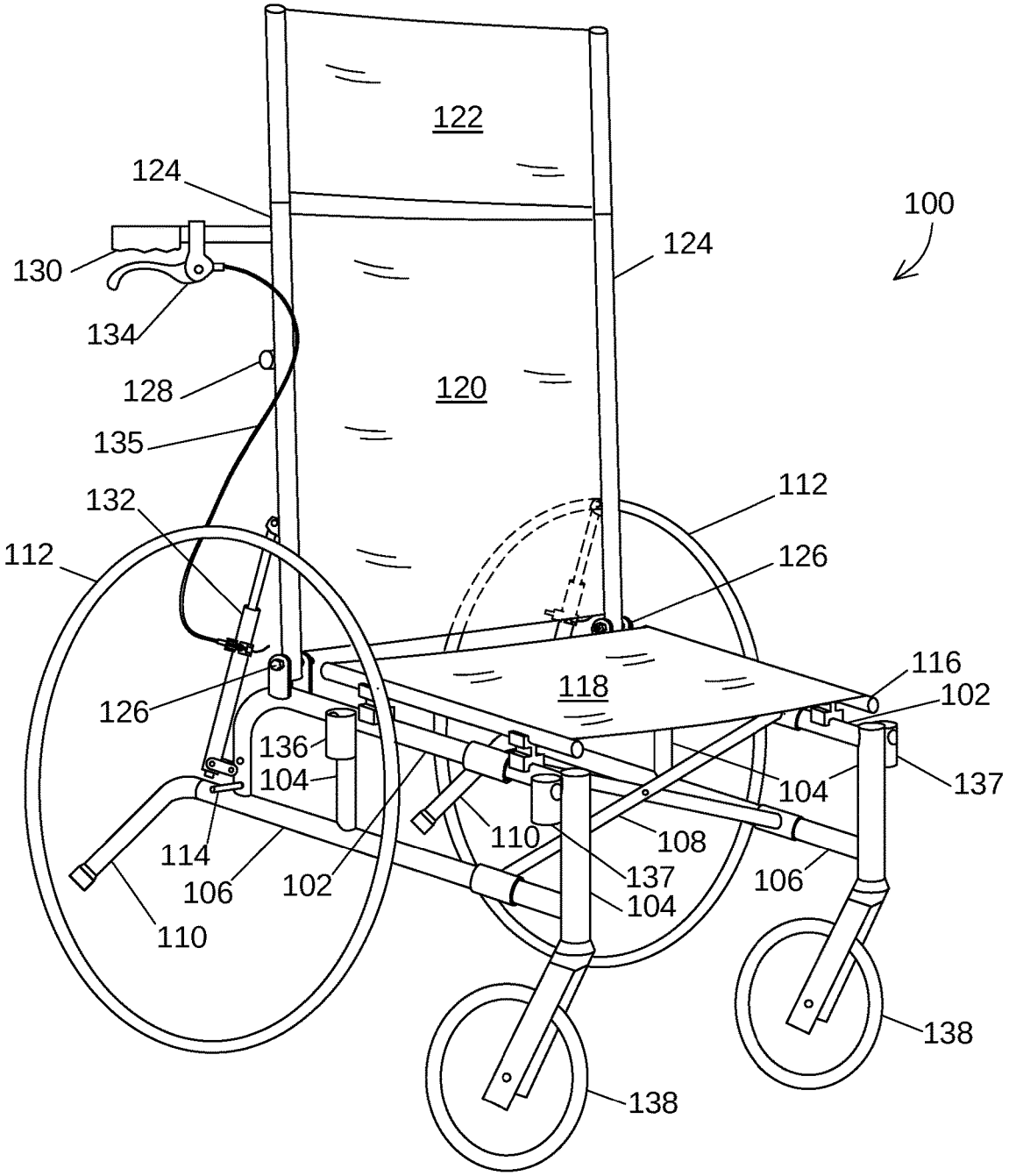
Prior art FIG. 1
FIG. 1 is a front perspective view of a commercial manual wheelchair in the prior art, which is shown for identification of its parts.

One aspect of the present invention relates to a wheelchair improvement kit applicable to a manual wheelchair. For reference in description of the wheelchair improvement kit, FIG. 1 shows a manual wheelchair 100 in the prior art, of a foldable type having a reclining backrest. In FIG. 1, wheelchair leg rests, armrests, and parts including wheel brakes, hub, and spokes are not shown. Although the following descriptions of the wheelchair improvement kit are based on the manual wheelchair 100 in FIG. 1, the wheelchair improvement kit as described and illustrated herein may also apply to other manual wheelchairs with minor modifications which should be apparent to one of ordinary skill in the art in light of the teachings herein.

The illustrated manual wheelchair 100 has a wheelchair frame including upper frame tubes 102 attached by vertical frame tubes 104 to lower frame tubes 106, and a frame cross brace 108. Typical anti-tip devices 110 are shown installed into the rear ends of the lower frame tubes 106. Main wheels 112 have axles 114 attached to points on the rear of the frame, behind front wheels 138. A seat 118 is suspended between seat tubes 116 attached to the upper frame tubes 102. In the illustrated manual wheelchair 100, the backrest 120 and headrest 122 are mounted between backrest tubes 124, which pivot at their lower ends about backrest pivots 126 attached to the frame behind the seat 118. The backrest 120 is prevented from rotating freely about the backrest pivot 126 by the backrest brake 132 attached between a point on the frame behind and below the backrest pivot 126 and a point on the backrest tube 124 above the backrest pivot 126. Backrest cross brace 128 is attached transversely across backrest tubes 124. The illustrated manual wheelchair 100 has two backrest brakes 132, one backrest brake 132 for each backrest tube 124. To change an angle of recline of the backrest 120, the caregiver supports the backrest 120 at caregiver handles 130, unlocks both backrest brakes 132 by backrest brake controls 134 acting through backrest brake cables 135 while changing the angle of recline, and relocks the backrest brakes 132 by the backrest brake controls when done. The backrest brake 132 is typically a lockable strut. Armrests if installed would sit in four armrest sockets, two rear armrest sockets 136 and two front armrest sockets 137, which typically have a hole in the bottom and a forward or rearward facing hole in the upper sidewall. The armrest sockets 136, 137 are considered to be parts of the wheelchair frame.

Figure 2:
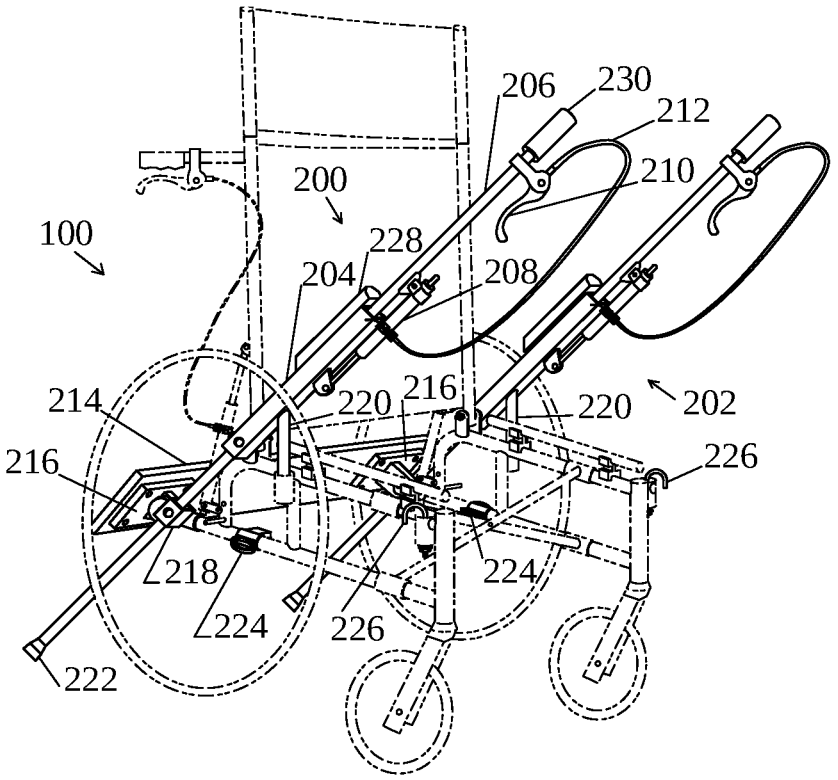
FIG. 2 is a front perspective view showing a wheelchair improvement kit mounted on a manual wheelchair, with a right and a left multifunction tube assembly in an anti-tip orientation, in an exemplary embodiment of the present invention.

In FIG. 2, right and left multifunction tube assemblies 200 and 202 of the wheelchair improvement kit in an exemplary embodiment of the present invention are shown mounted as a pair, one on each side of the manual wheelchair 100 of FIG. 1, the wheelchair armrests and standard anti-tip devices 110 having been removed. Right multifunction tube assembly 200 on the seated user's right-hand side and left multifunction tube assembly 202 on the user's left are mirror images of each other, with description of right multifunction tube assembly 200 applying in other aspects to the left multifunction tube assembly 202.

Figure 3:
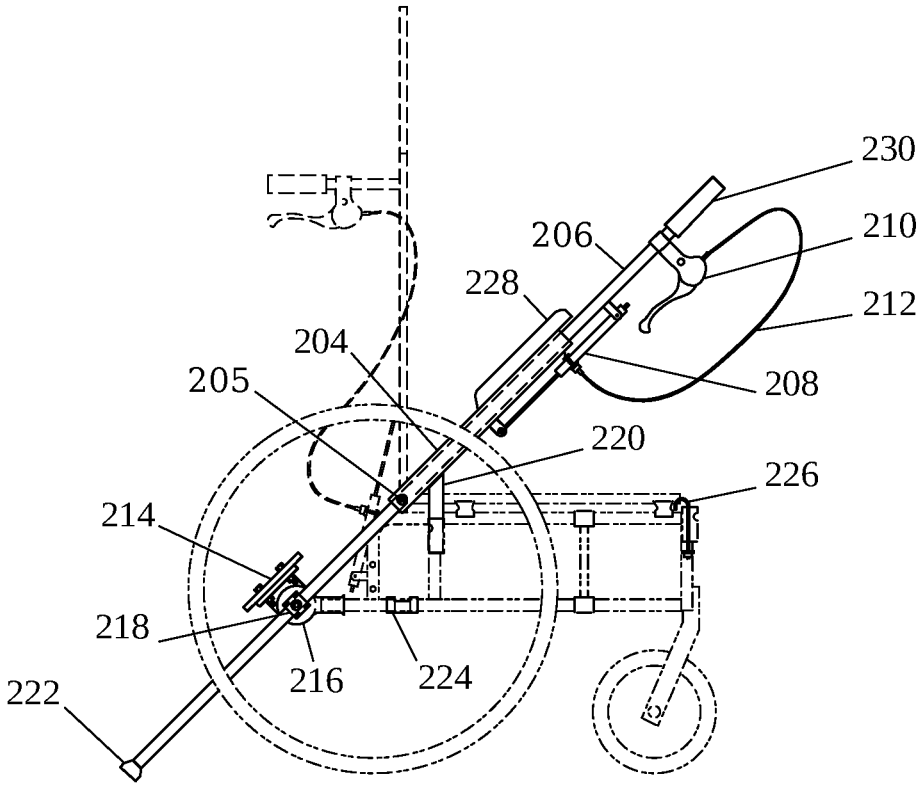
FIG. 3 is a side elevation view showing the wheelchair improvement kit mounted on a manual wheelchair with the multifunction tube assemblies in the anti-tip orientation in an exemplary embodiment of the present invention.

Referring to FIGS. 2 and 3, the right multifunction tube assembly 200 includes a mount tube 204, which is attached to the manual wheelchair 100 by a mount tube pivot bolt 205 about which the multifunction tube assembly can be rotated in a vertical plane parallel to the side of the wheelchair. The mount tube pivot bolt 205, obscured by slide tube 206 in FIGS. 2 and 3, is shown in the exploded view of the multifunction tube assembly in FIG. 4 and in a cross-section of a mount tube pivot 204 in FIG. 6. For attachment of the multifunction tube assembly 200 to a manual wheelchair 100, the mount tube pivot bolt 205 may replace the bolt used in the backrest pivot 126. For attachment to a wheelchair 100 of non-reclining type, the mount tube pivot bolt 205 would be attached through a hole drilled in the wheelchair frame near the intersection of backrest tube 124 and upper frame tube 102.

Referring again to FIGS. 2 and 3, the mount tube 204, when oriented for anti-tip use, extends diagonally upward towards the front of the wheelchair 100 at about a 45 degrees angle. A slide tube 206 slides freely within the mount tube 204, and extends beyond both ends of the mount tube 204. In an exemplary embodiment of the present invention, a slide tube brake 208 and slide tube brake control 210 clamped to the slide tube 206 allows the seated wheelchair user, using one hand on the brake control 210, to release the brake 208 and slide the slide tube 206 to a desired position relative to the mount tube 204, and for the position to be retained upon releasing the brake control 210.

The slide tube brake 208 is shown in the figures as a lockable strut of similar type as a commercially available backrest brake 132 used to retain the angle of recline of the backrest 120. In alternative embodiments, the slide tube brake 208 may be of other types, such as twist locks that operate by sliding the slide tube 206 to the desired position within mount tube 204 and twisting the slide tube 206 so as to engage a pinion attached to the slide tube 206 into a series of slots in the mount tube 204, or a low-force lockable gas strut. In the case of the lockable gas strut, it could be mounted with the lock release lever at the slide tube brake control 210 itself, removing necessity of slide tube brake cable 212.

Further referring to FIGS. 2 and 3, a kick plate 214 spanning crosswise between lower frame tubes 106 is mounted to the rear ends of the lower frame tubes 106 by swivel base tube clamps 216, which provide adjustment of the angle of inclination of the kick plate 214 relative to the lower frame tubes 106. The kick plate 214 is shown inclined upwards from horizontal at an angle approximately 45 degrees, but could, for example, be set horizontally. A guide tube 218 shorter than the mount tube 204 is attached to the swivel base tube clamp 216 so that the guide tube 218 is approximately coaxial with the mount tube 204.

A mount tube rest 220 sits in a rear armrest socket 136. The upper end of the mount tube rest 220 is machined at an angle and height so that the mount tube 204 resting on the mount tube rest 220 is aligned for the slide tube 206 to slide rearwards through the guide tube 218. The slide tube 206 when extended backwards through the guide tube 218 fixes the angle of inclination of the right multifunction tube assembly 200 to the angle of about 45 degrees from horizontal for anti-tip use. An anti-tip termination 222 may be attached to the lower end of the slide tube 206.

The right multifunction tube assembly 200, when oriented upright for use as a support pole, is constrained to be upright by the slide tube 206 passing through a guide ring 224 attached to the lower frame tube 106 directly below the mount tube pivot bolt 205. The right and left multifunction tube assemblies 200, 202, when oriented horizontally for use as handles for carrying the wheelchair 100 and the person in it, are constrained approximately to horizontal by two slide tube hold-down J-bolts 226 holding the slide tubes 200 down to upper frame tubes 102.

The right multifunction tube assembly 200 oriented for anti-tip use serves also as a replacement armrest, with the armrest pad 228 attached to the mount tube 204. A grip handle 230 is ergonomically located for the wheelchair user to hold for support while transitioning between sitting and standing, and while standing in front of the manual wheelchair 100.

Figure 4:
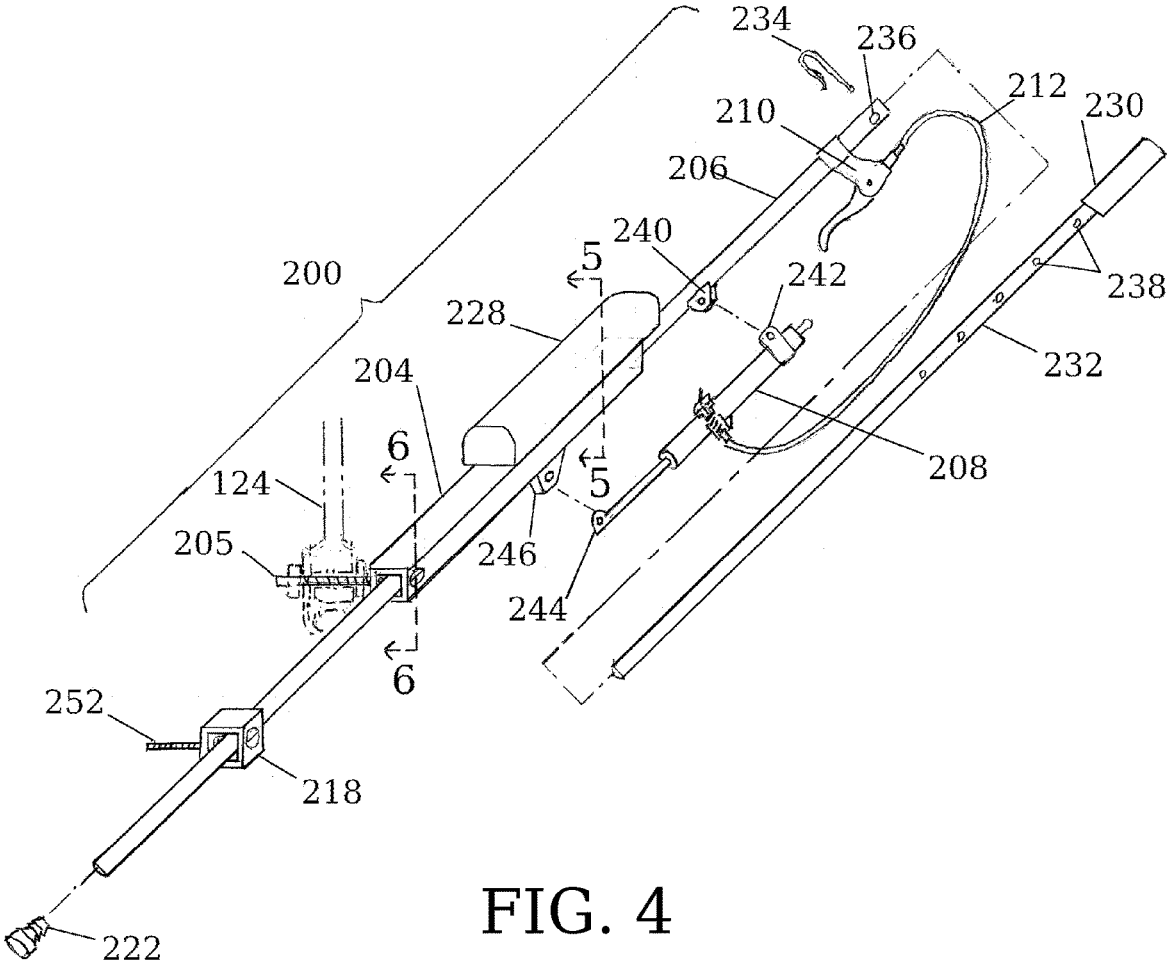
FIG. 4 is an exploded perspective view of the right multifunction tube assembly and a guide tube, with the multifunction tube assembly configured for use in the anti-tip orientation in an exemplary embodiment of the present invention; also, locations of cuts taken for sectional views are shown in FIGS. 5 and 6.
Figure 5:
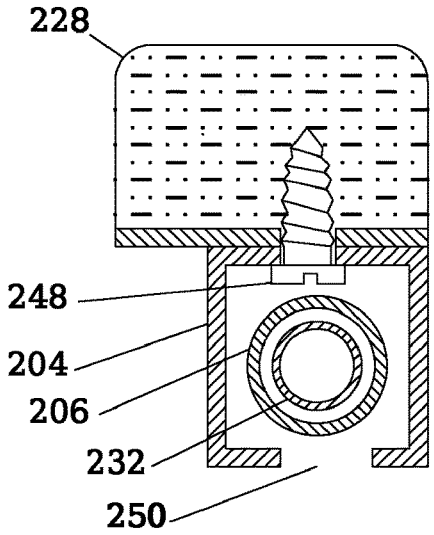
FIG. 5 is a sectional view taken across line 5-5 of an armrest pad and a mount tube in FIG. 4.
Figure 6:
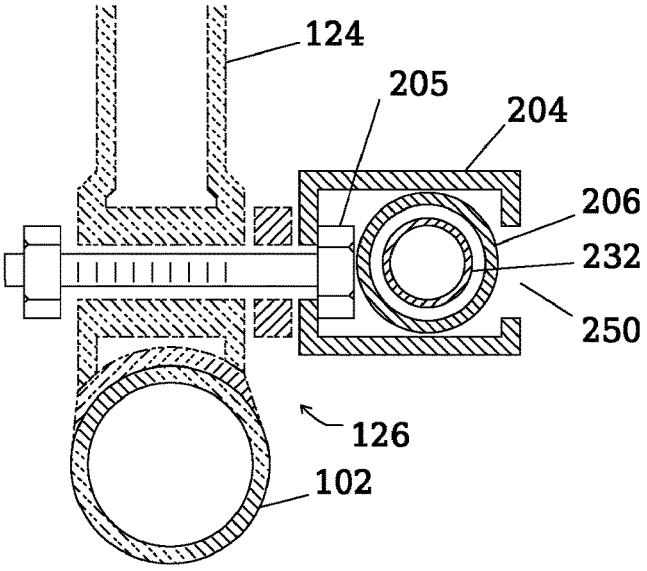
FIG. 6 is a sectional view taken across line 6-6 of a mount tube in FIG. 4, including a backrest pivot of a manual reclining backrest wheelchair.

FIGS. 4-6 show additional parts and details of the right multifunction tube assembly 200 on the seated user's right-hand side of the wheelchair 100, in addition to the guide tube 218 that sets the angle of inclination of the right multifunction tube assembly for use in the anti-tip orientation.

Referring to FIG. 4, the right multifunction tube assembly 200 is shown in an exploded view, including the extendable pole 232 in addition to mount tube 204, slide tube 206, slide tube brake 208, slide tube brake control 210 and slide tube brake cable 212, grip handle 230, anti-tip termination 222, and armrest pad 228 shown in FIGS. 2 and 3.

The mount tube 204 and guide tube 218 may be of square cross section, but could, for example, have a cross section with a circular inner perimeter and with outer machined flats or bushings in areas of the mount tube pivot bolt 205, armrest pad 228, and swivel base tube clamp 216, with countersinks for bolt heads configured so as not to interfere with a coaxial slide tube 206.

The extendable pole 232 may be inserted coaxially into slide tube 206 and removed for use as a full-length walking stick. The extendable pole 232, when fully inserted with grip handle 230 against the upper end of slide tube 206, is held in position by pole retaining pin 234 inserted through a pair of diametrically opposed slide tube holes 236 and the uppermost of pairs of diametrically opposed extendable pole holes 238. Farther extension of the extendable pole 232 from the slide tube 206 may be set by inserting the retaining pin 234 through slide tube holes 236 and a pair of diametrically opposed extendable pole holes 238 farther down from the grip handle 230. The pole retaining pin 234 may be of other types than shown, for example a push button ball lock pin, or pole retaining pin 234 could be omitted and push button spring clips positioned inside the extendable pole 232 at each diametrically opposing pair of extendable pole holes 238 in the extendable pole 232. The extendable pole 232 is typically a tube of aluminum, steel, or other material, but may be solid or strengthened as by inserting a tightly fitted wood dowel.

The anti-tip termination 222 at the lower end of the slide tube 206 may be of various types such as a wheel, non-skid cap or insert, spike, cross-punctured tennis ball, or flexible constant contact hose, and retained by friction of cap or barbed insert, spring clip, quarter turn twist lock, set screw, or similar means. In some embodiments, anti-tip terminations 222 too large to pass through the guide tube 218 may be removed and reattached when the slide tube 206 is withdrawn or reinserted through the guide tube 218.

The slide tube brake 208 has at its upper end a brake body clamp 242, which is bolted to brake body mounting tab 240 welded to slide tube 206, and the slide tube brake 208 has at its lower end a brake rod end fitting 244, which is fastened by bolt or removable pin to brake rod mounting tab 246, which is welded or bolted to a bottom surface of the mount tube 204.

FIG. 4 additionally shows where cuts are taken for cross-sectional views in FIGS. 5-6 showing various details.

FIG. 5 is a sectional view taken across line 5-5 of armrest pad 228 and mount tube 204, showing attachment of the armrest pad 228 to the mount tube 204 by armrest pad screw 248. The armrest pad 228 may be attached to the mount tube 204 by two such screws spaced lengthwise along the mount tube 204. An access hole 250 provides for inserting or removing the armrest pad screw 248 when the slide tube 206 and the extendable pole 232 are removed from the mount tube 204.

FIG. 6 is a sectional view taken across line 6-6 of FIG. 4, showing the backrest pivot 126 of the manual wheelchair 100 and the mount tube pivot bolt 205. In an embodiment of the wheelchair improvement kit, for attachment of the mount tube 204 to the manual wheelchair 100, the mount tube pivot bolt 205 replaces an original and possibly shorter pivot bolt in the backrest pivot 126. For attaching the right multifunction tube assembly 200 to a non-reclining wheelchair 100, the mount tube pivot bolt 205 passes through a frame tube at or adjacent to the intersection of backrest tube 124, or its continuation as a rear vertical frame tube 104, and upper frame tube 102. Access hole 250 provides for inserting or removing the mount tube pivot bolt 205, when slide tube 206, and extendable pole 232 if it extends this far, are removed from the mount tube 204.

Figure 7:
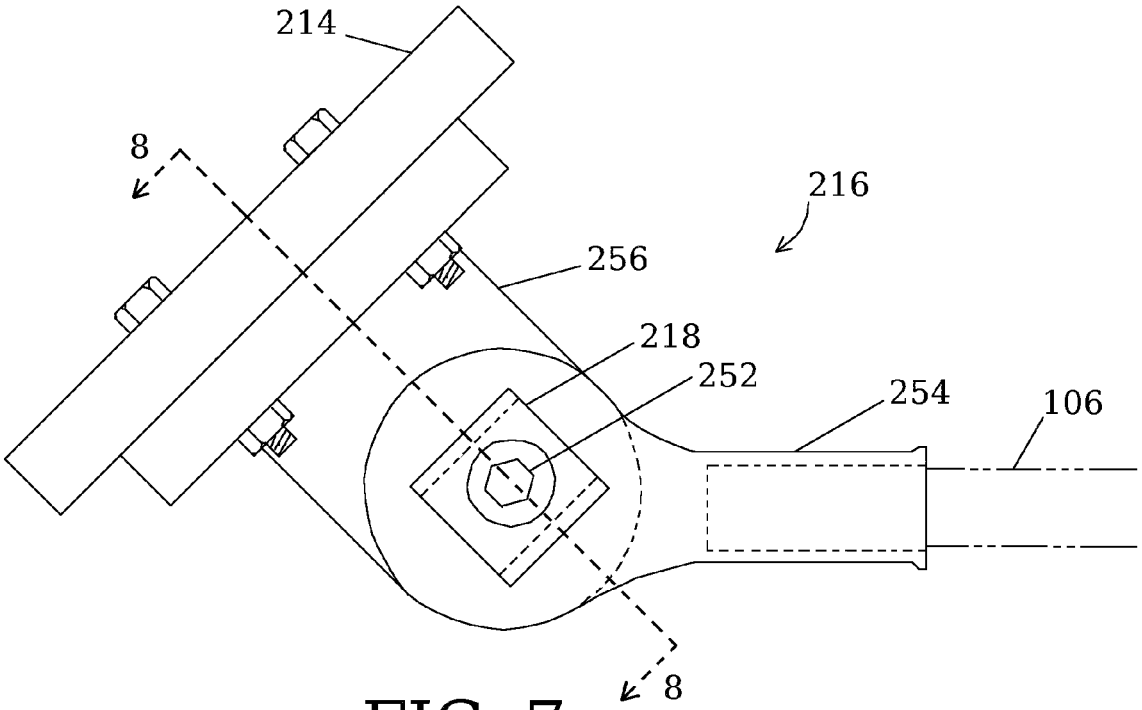
FIG. 7 is a side elevation view showing attachment of a kick plate, a lower frame tube, and a guide tube to a swivel base tube clamp in an exemplary embodiment of the present invention.

FIG. 7 is a side elevation view of a swivel base tube clamp 216, which attaches the kick plate 214 to the rear end of a lower frame tube 106. The kick plate 214 is bolted to a swivel base 256, and the frame tube 106 is clamped or fixed by set screws to a swivel tube clamp 254. Loos-ening swivel bolt 252 allows rotation of the swivel base 256 relative to swivel tube clamp 254, setting the angle of inclination of the kick plate 214. The guide tube 218 is bolted to the swivel base tube clamp 216, and is rotationally positioned to allow the slide tube 206 to pass through it when the right multifunction tube assembly 200 is oriented for anti-tip use.

Figure 8:
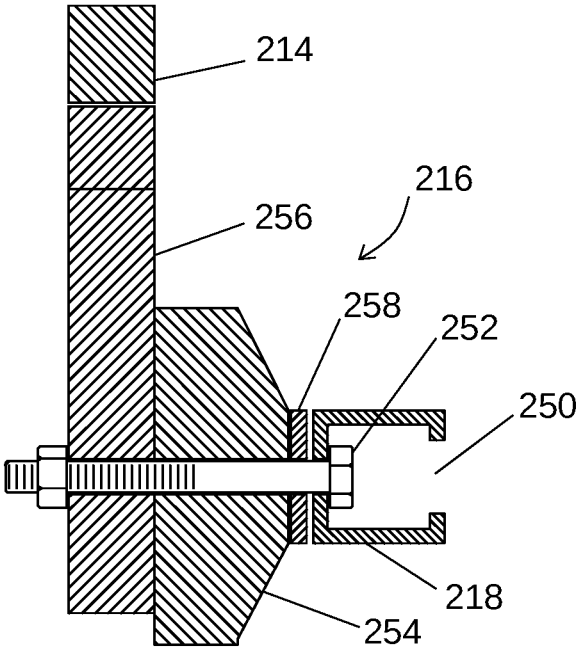
FIG. 8 is a sectional view taken across line 8-8 of the swivel base tube clamp and attached parts in FIG. 7.

FIG. 8 is a sectional view taken across line 7-7 in FIG. 7, showing attachment of the guide tube 218 to the swivel base tube clamp 216. Guide tube 218 is attached to a commercially available swivel base tube clamp 216 by swivel bolt 252 and a spacer washer 258 aligns guide tube 218 coplanar with mount tube 204. Access hole 250 provides for inserting or removing the swivel bolt 252, when slide tube 206 is withdrawn from the guide tube 218.

Figure 9:
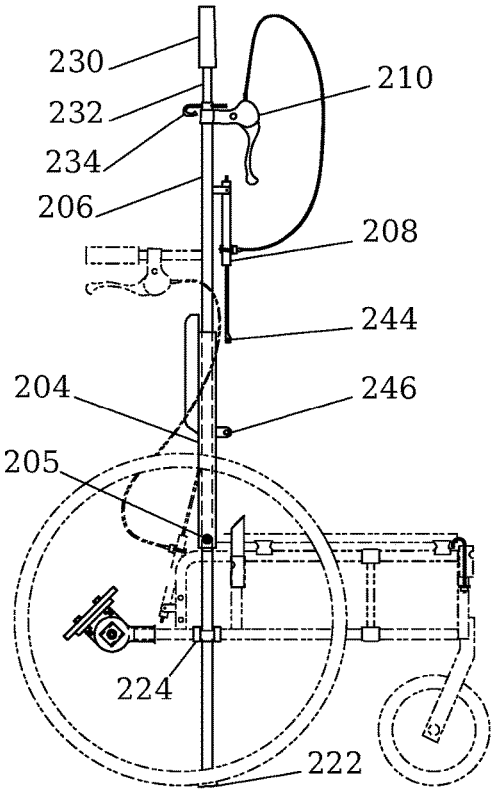
FIG. 9 is a side elevation view of the right multifunction tube assembly with the multifunction tube assembly configured in an upright orientation in an exemplary embodiment of the present invention.

FIG. 9 is a side elevation view of the manual wheelchair 100 showing the right multifunction tube assembly 200 rotated to an upright position. The extendable pole 232 with a grip handle 230 is partially extended out from the slide tube 206 and retained in the extended position by a pole retaining pin 234 inserted through slide tube holes 236 and an appropriate pair of diametrically opposed extendable pole holes 238. The right and left multifunction tube assemblies 200 and 202 in this configuration are able to support a canopy to protect the wheelchair user from external elements, such as rain, wind, or snow. The vertical rotation may require detachment of the brake rod end fitting 244 of the slide tube brake 208 from the brake rod mounting tab 246 on the mount tube 204, in order to slide the slide tube 206 out of the guide tube 218 to perform the required rotation to the vertical position. In an exemplary embodiment, the brake rod end fitting 244 is attached to the brake body mounting tab 246 by a bolt with a wing nut to facilitate its removal. In another embodiment, when the right multifunction tube assembly 200 is oriented upright for use as a support pole, the right multifunction tube assembly 200 is constrained to the upright orientation by passing the slide tube 206 through the guide ring 224 which is attached to the lower frame tube 106 directly below the mount tube pivot bolt 205.

Figure 10:
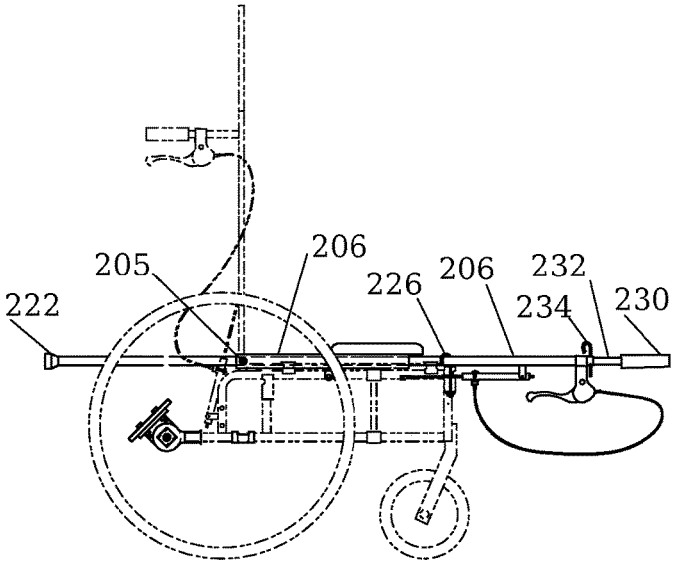
FIG. 10 is a side elevation view of the right multifunction tube assembly with the multifunction tube assembly configured in a horizontal orientation in an exemplary embodiment of the present invention.

FIG. 10 is a side elevation view of the manual wheelchair 100 showing the right multifunction tube assembly 200 rotated to and restrained to a horizontal position. In an embodiment for a manual wheelchair 100 having front armrest sockets 137, the right multifunction tube assembly 200 is restrained to the horizontal position by hooking slide tube hold-down J-bolt 226 over slide tube 206. The threaded shaft of the slide tube hold-down J-bolt passes through a hole in bottom of the front armrest socket 137 and is secured against upward motion by a washer and nut, which may be tightened if desired to set the horizontal orientation of the slide tube 206 after hooking the slide tube hold-down J-bolt over the slide tube 206. The slide tube 206 may be restrained to horizontal by other means, such as by a hook clamped to upper frame tube 102 or by a strap encircling upper frame tube 102 and slide tube 206 with strap ends connected by eyelet and snap hook or buckle. The extendable pole 232 may be partially extended out from the slide tube 206 and retained in the extended position by a pole retaining pin 234. The right and left multifunction tube assemblies 200 and 202 configured in this way, extending from behind the rear of the main wheels 112 to beyond the front of the manual wheelchair 100, provide handles for a person behind and a person in front to carry the wheelchair with its occupant across obstacles or difficult terrain.

Figure 11:
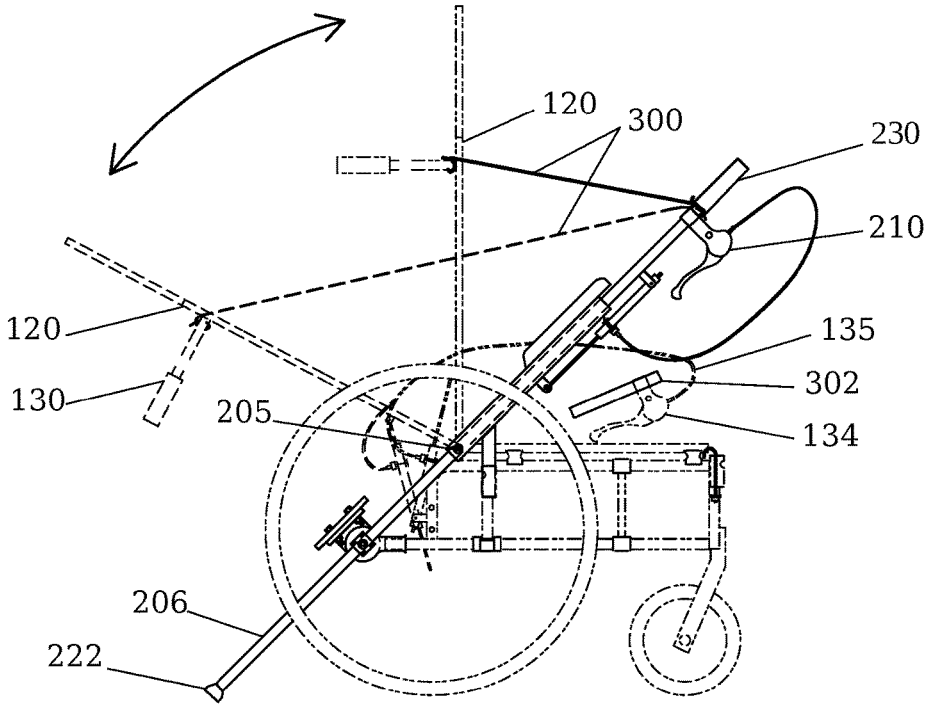
FIG. 11 is a side elevation view showing the wheelchair improvement kit configured for use as a user controlled reclining backrest wheelchair in upright and reclined positions in an exemplary embodiment of the present invention.

FIG. 11 is a side elevation view of a manual wheelchair 100 showing the right multifunction tube assembly 200 in anti-tip orientation with reclining backrest elastic band 300 and relocated backrest brake control 134, providing user control of the reclining backrest 120. The backrest 120 is shown in an upright position and an alternative reclined position in FIG. 11. In most reclining backrest wheelchairs 100, the backrest angle of recline is adjusted by means of a backrest brake 132, which may be operated by a bicycle type brake control and cable as shown in the backrest brake control 134. In one embodiment, the backrest brake controls 134 are removed from the caregiver handles 130 and attached instead to stub tubes 302 of length sufficient for the wheelchair user to grab and operate the level. The backrest brake controls 134 may then be moved from behind the backrest 120, where they are out of reach of the seated wheelchair user, to a location in the front of the backrest 120 within easy reach of the wheelchair user so that the wheelchair user can change the backrest reclining angle without a caregiver's assistance. The reclining backrest elastic bands 300 provide a counterbalancing torque for the wheelchair backrest 120 when the backrest brake control 134 is used by the wheelchair user to change the change the backrest reclining angle.

Figure 12A:
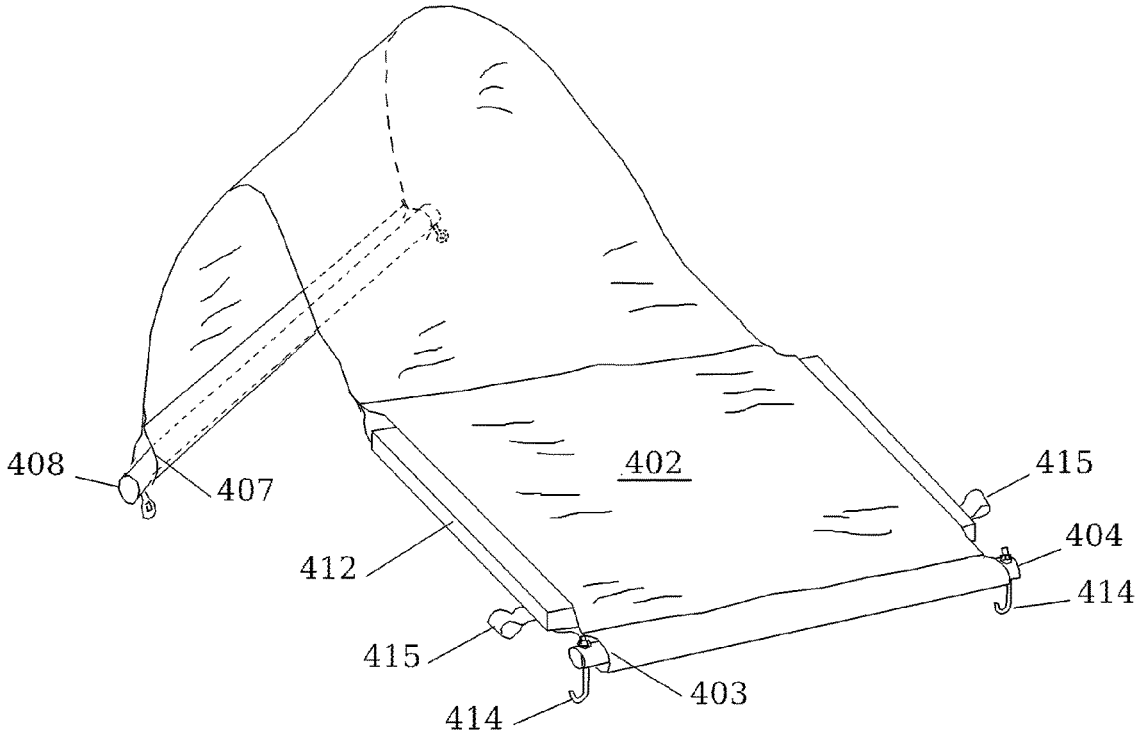
FIG. 12A is a perspective view of a first seat attachment in an exemplary embodiment of the present invention.
Figure 12B:
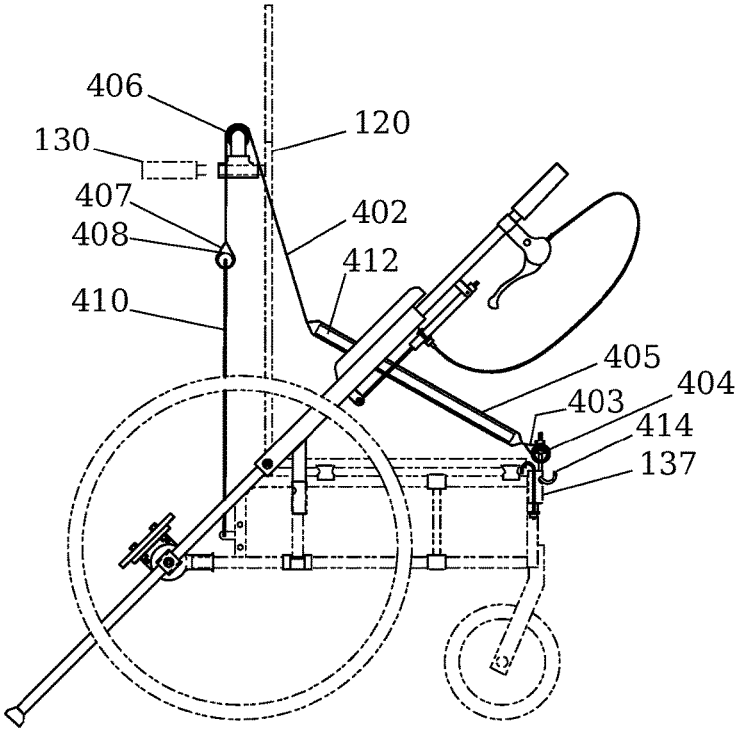
FIG. 12B is a side elevation view showing the first seat attachment configured for use as a seat lift assist device in an exemplary embodiment of the present invention.

FIGS. 12A and 12B show a perspective view of a first seat attachment 400 and its attachment to a manual wheelchair 100. In one embodiment, the first seat attachment 400 comprises a rectangular fabric 402 covering the seat 118 and backrest 120 of the wheelchair. A seat board 412 is inserted into a fabric pocket 405 of the seat attachment 400. A seat board strap 415 passes under the seat board 412 alongside its front edge. The ends of the strap 415 fold over upon themselves providing two loops, one near each front corner of the seat board 412. Three horizontal tubes 404, 406, 408 are mounted across the wheelchair crosswise. A first horizontal tube 404 is clipped to front armrest sockets 137 or to other parts of the wheelchair frame on either side of the seat front by a pair of seat hinge J-bolts 414. A second horizontal tube 406 is removably attached between the caregiver handles 130. A third horizontal tube 408 is attached by a pair of last tube elastic bands 410, one last tube elastic band 410 attached to the right end of the third horizontal tube 408 and one to the left, and each last tube elastic band 410 attached at its opposite end to a point on the corresponding side of the wheelchair frame below the backrest pivot 126. For manual wheelchairs 100 having alternative attachment points at different heights from ground for main wheel axles 114 and unused upper axle attachment points, eyebolts in the upper axle attachment points may be used to attach lower ends of the last tube elastic bands 410. The length of the rectangular fabric 402 and of the last tube elastic bands 410 is such that when the backrest 120 is in the upright position, the rectangular fabric 402 lies on the wheelchair seat 118, and the last tube elastic bands 410 are selected to provide a desired resistance to an increased angle of recline of the backrest 120. One end of the rectangular fabric 402 is attached around the first horizontal tube 404 and seamed crosswise to form a closed fabric loop 403 around the first horizontal tube 404. Additionally, the end of the fabric 402 includes a fabric pocket 405 into which the seat board 412 is laterally inserted. The opposite end of the rectangular fabric passes over the second horizontal tube 406 and on downward behind the backrest 120 to the third horizontal tube 408. The rectangular fabric is wrapped around the third horizontal tube 408 and seamed crosswise to form a closed fabric loop 407 around the third horizontal tube 408. In the first seat attachment 400, the third horizontal tube 408 is also the last horizontal tube.

Figure 13:
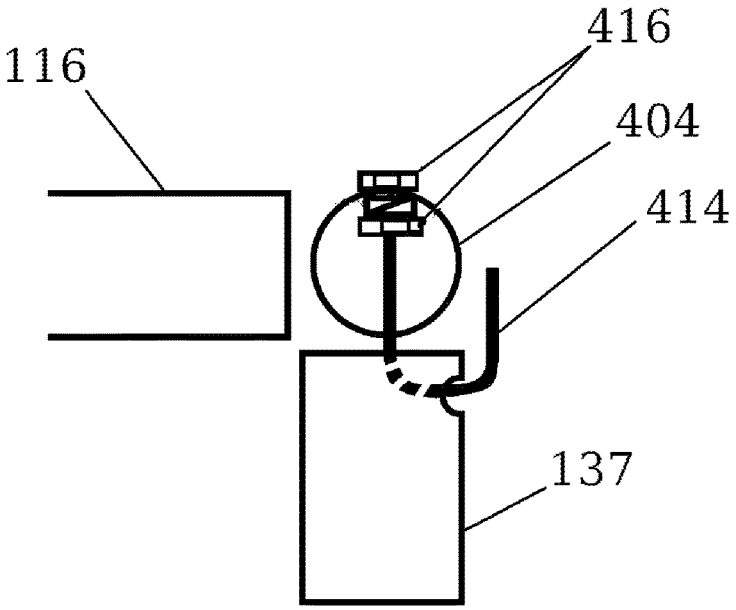
FIG. 13 is a detailed view of a J-bolt attachment of a first horizontal tube to the wheelchair front armrest socket in an exemplary embodiment of the present invention.

FIG. 13 is a partial cut away side elevation view showing a seat hinge J-bolt 414 bolted with J-bolt nuts 416 diametrically across first horizontal tube 404 near one end of the tube. The seat hinge J-bolts 414 are bolted one near each end of the first horizontal tube 404 so that the first horizontal tube may easily be attached or removed from the manual wheelchair 100 by unhooking the seat hinge J-bolts 414 from holes in the front armrest sockets 137 or other parts of the wheelchair frame.

Figure 14:
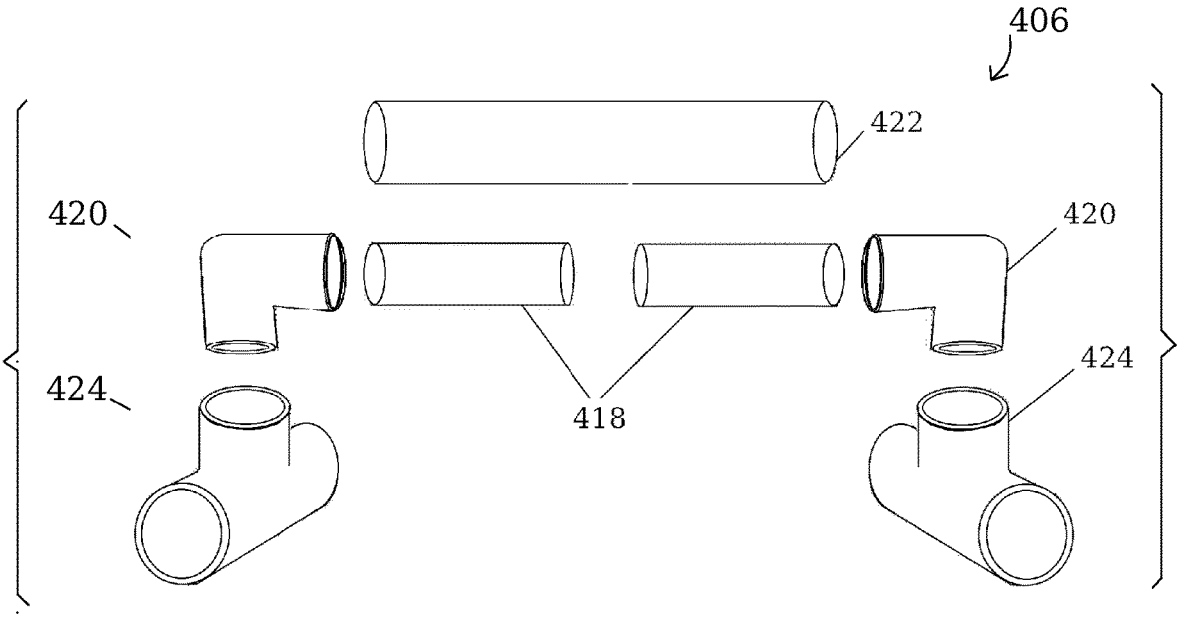
FIG. 14 is an exploded perspective view of a second horizontal tube for mounting between a pair of wheelchair caregiver handles in an exemplary embodiment of the present invention.

FIG. 14 is an exploded perspective view of one embodiment of the second horizontal tube 406, as may be assembled from readily available Sch 40 PVC pipe and fittings. In this embodiment, the second horizontal tube 406 is built from two inline horizontal tubes 418, two elbow connectors 420, one rotatable horizontal tube 422 with a diameter larger than the inline horizontal tubes 418, and two T connectors 424. Each of the two inline tubes 418 is attached at an end of an elbow connector 420, and then slid coaxially into rotatable horizontal tube 422 from opposite ends. The rotatable horizontal tube 422 is then able to freely rotate around the inline tubes 418 so as to reduce resistance to motion of the rectangular fabric 402 that passes over it. The elbow connectors 420 are each attached at their other end to the center port of a corresponding T connector 424, and the T connectors 424 slid over the caregiver-handles 130. In an alternative embodiment of the second horizontal tube 406, a second horizontal tube 406 is attached by a pair of right-angle pipe clamps to span caregiver handles 130, each right-angle pipe clamp attaching one end of the second horizontal tube to a corresponding caregiver handle 130.

The first seat attachment 400 in FIG. 12B may function as a seat lift assist device to assist the wheelchair user from seated to standing position and back. The last tube elastic bands 410 cause tension in the rectangular fabric 402 that applies an upward force to the rear edge of the seat board 412 and tends to lift the rear edge of the seat board 412 to help the wheelchair user stand up from or sit back into the wheelchair. A release, such as a band over the back of the seat board 412, may be hooked to the upper frame tubes 102 or into the bottoms of the rear armrest sockets 136 to restrain unintended actuation of seat lift assist. Alternatively, two releases may be attached one each to points on upper frame tube 102 or seat tube 116 so as to hook eyelets in opposite rear corners of the seat board 412. The seat lift assist device functions such that when the release is released, the rectangular fabric 402 covering the backrest 120 applies an upward force to the rear edge of the seat board 412.

Figure 15:
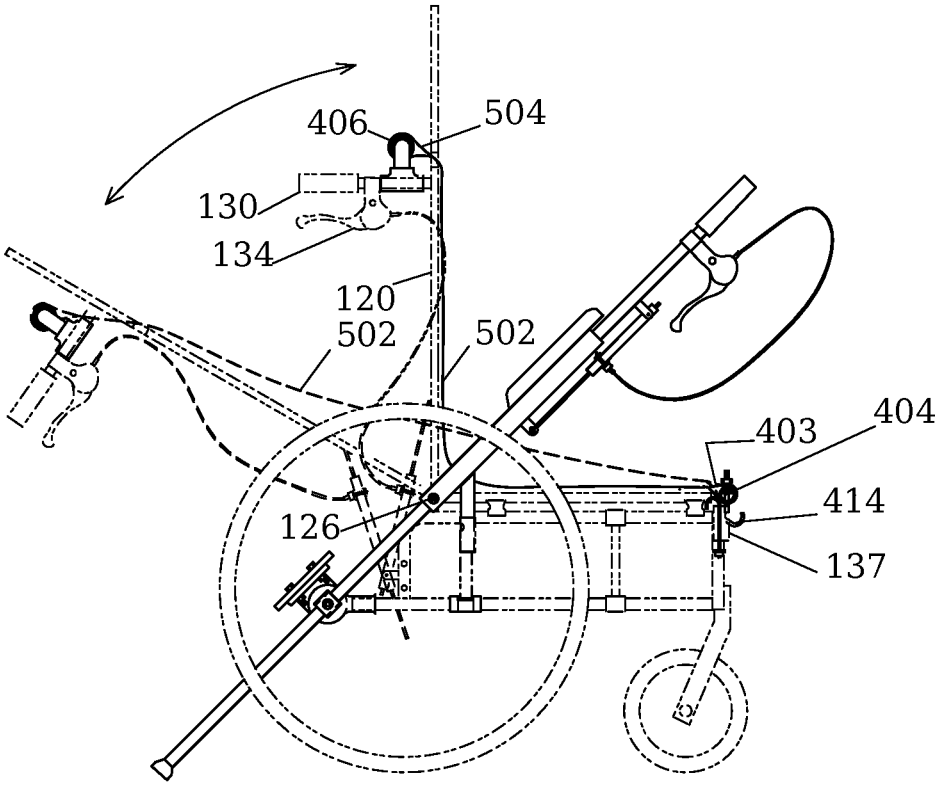
FIG. 15 is a side elevation view showing a first seat attachment configured for full body flexion/extension exercise in an exemplary embodiment of the present invention.

FIG. 15 is a side elevation view showing a second seat attachment in an embodiment for manual wheelchairs 100 having a reclining backrest. In this embodiment, the second seat attachment comprises the first horizontal tube 404 and the second horizontal tube 406 mounted across the wheelchair frame as for the first seat attachment 400, and a second rectangular fabric 502 covering the seat 118 and backrest 120 of the wheelchair. The first horizontal tube 404 is clipped by a pair of seat hinge J-bolts 414 to holes in the front armrest sockets 137 or other parts of the wheelchair frame. The second horizontal tube 406 is removably attached between the caregiver handles 130. One end of the second rectangular fabric 502 is attached around the first horizontal tube 404 and seamed crosswise to form a first fabric loop 403 around the first horizontal tube 404. The opposite end of the second rectangular fabric 502 is attached around the second horizontal tube 406 and seamed crosswise to form a second tube fabric loop 504 around the second horizontal tube 406.

The first seat attachment 400 shown in FIG. 12A and the second seat attachment shown in FIG. 15 may be used for a full body flexion/extension exercise. For this use, the lower ends of last tube elastic bands 410 of the first seat attachment 400 are repositioned from points on the wheelchair frame below the backrest pivot 126 to points forward of the backrest pivot 126 along the upper frame tubes 102. When the backrest 120 is in the upright position, the rectangular fabric 402 or 502 lies on the wheelchair seat 118, but when the backrest is reclined, the rectangular fabric rises above the seat to suspend the wheelchair user in midair. The exercise is performed by the user leaning back while raising and lowering oneself, thereby flexing and extending the whole body. In the reclined position, the rectangular fabric 402 or 502 also serves as a ham-mock, providing a comfortable change of position, aeration, and reduction and redistribution of pressure on the user's skin.

Figure 16:
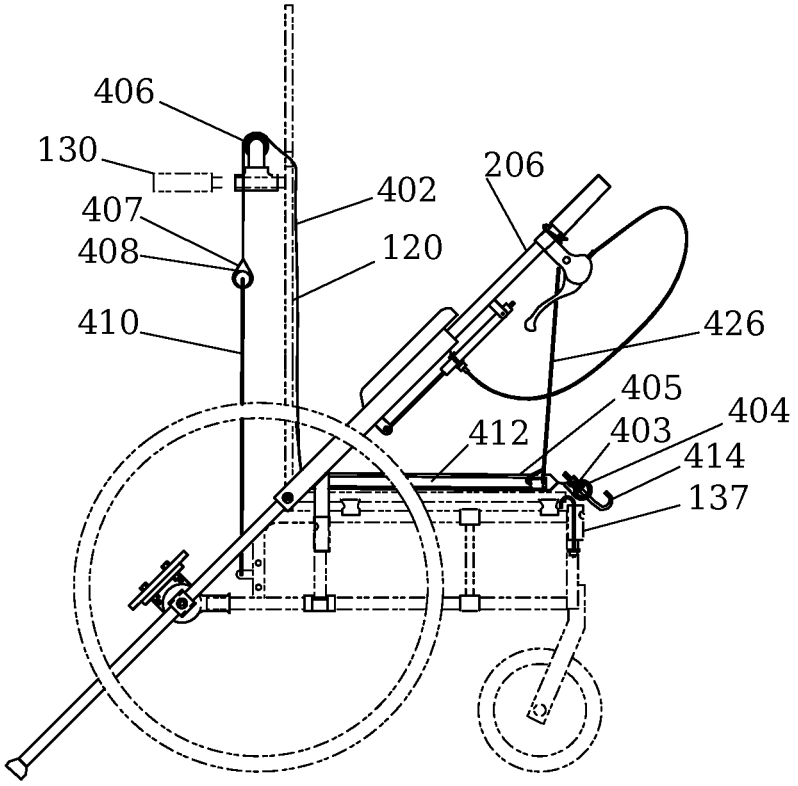
FIG. 16 is a side elevation view showing a seat elevation device configured for to lift a seat board upward in an exemplary embodiment of the present invention.

FIG. 16 is a side elevation view showing implementation of a seat elevation device assembled from the first seat attachment 400 with a seat board 412 in the pocket of the seat attachment 400 and first horizontal tube 404 detached from the wheelchair front armrest sockets 137 or other parts of the wheelchair frame by unhooking seat hinge J-bolts 414. In this embodiment, the seat elevation device provides force urging upward motion of the entire seat board 412. The seat board 412 is raised by four elastic bands, two of which are front elastic bands 426, one on the left side and one on the right side, each connected to a loop in seat board strap 415 attached near a front corner of the seat board 412 and to the corresponding upper end of a slide tube 206. The other two elastic bands are the same last tube elastic bands 410 of the first seat attachment 400. The last tube elastic bands 410 are connected one each to opposite ends of the third horizontal tube 408 and apply upward force to the rear of the seat board 412 by tension in rectangular fabric 402. The lower ends of the last tube elastic bands 410 are connected to points of the wheelchair frame below the backrest pivot 126. For a seat board 412 having a central opening and rectangular fabric 402 having a corresponding opening in the area of the fabric pocket 405 of the seat attachment 400, this assists the wheelchair user, or the wheelchair user with help from a caregiver, in rising sufficiently for one to insert a bedpan under the seat board 412 and for the user to sit back down on it for toiletry and to rise afterwards for washing.

A second aspect of the present invention relates to a novel manual wheelchair 100 built with most of the features disclosed in the wheelchair improvement kit, which includes the right and left multifunction tube assemblies 200 and 202, ergonomically located long grip handles 230, and extendable poles 232. Other features include an angled seat lift assist device and a seat elevation device. For the case of a reclining manual wheelchair, optional features further include relocation of the backrest brake controls 134 and provision of counterbalancing torque to enable the wheelchair user to raise and lower the backrest without a caregiver's assistance, and a first seat attachment 400 and second seat attachment for full body flexion/extension exercise. Description of the invention in relation to the novel manual wheelchair is referenced from the descriptions of corresponding parts in the wheelchair improvement kit.

Minor changes may be expected within the scope of the present patent application as it relates to the application as an add-on to various existing wheelchair models. For example, some wheelchairs may require extensions or fittings attached to ends of lower frame tubes to mount guide tubes in position set multifunction tube assemblies in anti-tip orientation. Also, although the present patent application relates to manual wheelchairs 100, other person-carrying facilities, such as household and beach chairs, beds, and physical therapy devices, may be applied advisedly.

What is claimed is:

1. A wheelchair improvement kit configured to be installed together with a manual wheelchair, wherein the wheelchair improvement kit comprises an anti-tip device including:

a. a pair of multifunction tube assemblies for mounting one on each side of the wheelchair, each multifunction tube assembly including:

i. a mount tube configured for pivotally mounting on a side of the wheelchair, wherein the mount tube is rotatable in a vertical plane parallel to a side of the wheelchair, and wherein when the multifunction tube assembly functions as the anti-tip device, the mount tube is oriented diagonally upward towards a front of the wheelchair;

ii. a slide tube slidably engaged to the mount tube, wherein upper and lower ends of the slide tube extend beyond the mount tube;

iii. a slide tube brake configured for engaging or releasing a position of the slide tube relative to the mount tube; and iv. an extendable pole inserted into a top of the slide tube, an upper end of the pole being fitted with a hand grip;

and b. a pair of guide tubes configured for mounting one on each side of the wheelchair, wherein each guide tube when mounted is positioned below the mount tube, and wherein when the multifunction tube assembly functions as the anti-tip device, the slide tube passes through the guide tube.

2. The improvement kit of claim 1, wherein the anti-tip device further comprises a kick plate configured for mounting on a frame of the wheelchair and to a rear of a rear wheel axle of the wheelchair and to a rear of the guide tubes.

3. The improvement kit of claim 1, wherein the extendable pole is removable from the slide tube to be useful as a walking stick.

4. The improvement kit of claim 1, wherein each multifunction tube assembly is configured to function as a supporting pole when the mount tube is rotated to set the multifunction tube assembly oriented upright.

5. The improvement kit of claim 1, wherein the lower end of the slide tube is connected to an anti-tip termination selected from a group including a wheel, an inserted plug, a non-skid cap, a flexible hose, or a spike.

6. The improvement kit of claim 1, wherein the manual wheelchair comprises a reclining backrest wheelchair having a backrest brake and a backrest brake control, the improvement kit further comprising:

a. a means for repositioning the backrest brake control to be within reach of a seated wheelchair user; and b. a pair of elastic bands configured to be connected one on each side of the wheelchair, wherein each elastic band is configured to be positioned between the upper end of the slide tube and a point near an upper portion of the wheelchair backrest such that a counterbalancing torque is applied to the backrest when the backrest brake control releases the backrest brake.

7. The improvement kit of claim 1, further comprising a seat attachment for the wheelchair, the seat attachment including:

a. a fabric to cover the wheelchair; and b. a plurality of horizontal tubes configured for mounting across the wheelchair crosswise, wherein a first one of the horizontal tubes is removably attached to a frame of the wheelchair in front of a seat, and a second one of the horizontal tubes is mounted on a frame of the wheelchair behind a backrest, a front end of the fabric being attached around the first horizontal tube and seamed crosswise to form a closed loop around the first horizontal tube, and an opposite end of the fabric being attached around a last horizontal tube and seamed crosswise to form a closed loop around the last horizontal tube.

8. The improvement kit of claim 7, further comprising a J-bolt configured for attaching the first horizontal tube to the wheelchair frame.

9. The improvement kit of claim 7, wherein the plurality of horizontal tubes comprises the first horizontal tube and the second horizontal tube, the second horizontal tube being the last horizontal tube.

10. The improvement kit of claim 7, wherein the plurality of horizontal tubes comprises three horizontal tubes, including the first horizontal tube, the second horizontal tube, and a third horizontal tube, the third horizontal tube being the last horizontal tube, wherein the fabric is configured to pass from the first horizontal tube over the second horizontal tube to the last horizontal tube, and wherein the last horizontal tube is further configured to connect to a section of the wheelchair frame below the last horizontal tube by a pair of elastic bands connected at their upper ends to opposite ends of the last horizontal tube and at their lower ends to points on the corresponding side of the wheelchair frame below the last horizontal tube.

11. The improvement kit of claim 10, further comprising a seat lift assist device, wherein the seat lift assist device includes:

a. a seat board inserted into a pocket attached to the fabric adjacent to the closed loop around the first horizontal tube; and b. a release to restrain a rear edge of the seat board from upward motion;

wherein the seat lift assist device is configured to function such that when the release is released, the fabric applies an upward force to the rear edge of the seat board.

12. The improvement kit of claim 10, further comprising a seat elevation device configured to lift a seat board upward, wherein the seat elevation device includes:

a. a seat board inserted into a pocket attached to the fabric adjacent to the closed loop around the first horizontal tube; and b. a plurality of elastic bands, two of the elastic bands being connected each one between a front corner of the seat board and a corresponding upper end of the slide tube, wherein the seat lift elevation device is configured to function such that when the first horizontal tube is detached from the wheelchair frame, the fabric applies an upward force to a rear edge of the seat board and the two of the elastic bands apply an upward force to a front edge of the seat board.

13. A manual wheelchair comprising a wheelchair frame, a seat, a backrest, a plurality of wheels, and an anti-tip device, wherein the anti-tip device includes:

a. a pair of multifunction tube assemblies mounted one on each side of the wheelchair, each multifunction tube assembly including:

i. a mount tube pivotally mounted on a side of the wheelchair, wherein the mount tube is rotatable in a vertical plane parallel to a side of the wheelchair, and wherein when the multifunction tube assembly functions as the anti-tip device, the mount tube is oriented diagonally upward towards a front of the wheelchair;

ii. a slide tube slidably engaged to the mount tube, wherein upper and lower ends of the slide tube extend beyond the mount tube;

iii. a slide tube brake configured for engaging or releasing a position of the slide tube relative to the mount tube; and iv. an extendable pole inserted into a top of the slide tube, and an upper end of the pole being fitted with a hand grip; and b. a pair of guide tubes mounted one on each side of the wheelchair, wherein each guide tube is positioned below the mount tube and wherein when the multifunction tube assembly functions as the anti-tip device the slide tube passes through the guide tube.

14. The manual wheelchair of claim 13, wherein the anti-tip device further comprises a kick plate mounted on a frame of the wheelchair and to a rear of a rear wheel axle of the wheelchair and to a rear of the guide tubes.

15. The manual wheelchair of claim 13, wherein the manual wheelchair comprises a reclining backrest wheelchair.

16. The manual wheelchair of claim 15, wherein the angle of recline of the backrest is controlled by a backrest brake and a backrest brake control positioned within reach of a seated wheelchair user, the reclining backrest wheelchair further comprising a pair of elastic bands connected one on each side of the wheelchair, wherein each elastic band is positioned between the upper end of the slide tube and a point near an upper portion of the backrest such that a counterbalancing torque is applied to the backrest when the backrest brake control releases the backrest brake.

17. The manual wheelchair of claim 13, wherein the extendable pole is removable from the slide tube to be useful as a walking stick.

18. The manual wheelchair of claim 13, wherein each multifunction tube assembly is configured to function as a supporting pole when the mount tube is rotated to set the multifunction tube assembly oriented upright.

19. The manual wheelchair of claim 13, wherein the lower end of the slide tube is connected to an anti-tip termination selected from a group including a wheel, an inserted plug, a non-skid cap, a flexible hose, or a spike.

20. The manual wheelchair of claim 13, further comprising a seat attachment for the wheelchair, the seat attachment including:

a. a fabric covering the wheelchair; and b. a plurality of horizontal tubes mounted across the wheelchair crosswise, wherein a first one of the horizontal tubes is removably attached to a frame of the wheelchair in front of a seat, and a second one of the horizontal tubes is mounted on a frame of the wheelchair behind a backrest, a front end of the fabric being attached around the first horizontal tube and seamed crosswise to form a closed loop around the first horizontal tube, and an opposite end of the fabric being attached around a last horizontal tube and seamed crosswise to form a closed loop around the last horizontal tube.

21. The manual wheelchair of claim 20, further comprising a J-bolt configured for attaching the first horizontal tube to the wheelchair frame.

22. The manual wheelchair of claim 20, wherein the plurality of horizontal tubes comprises the first horizontal tube and the second horizontal tube, the second horizontal tube being the last horizontal tube.

23. The manual wheelchair of claim 20, wherein the plurality of horizontal tubes comprises three horizontal tubes, including the first horizontal tube, the second horizontal tube, and a third horizontal tube, the third horizontal tube being the last horizontal tube, wherein the fabric is configured to pass from the first horizontal tube over the second horizontal tube to the last horizontal tube, and wherein the last horizontal tube is further connected to a section of the wheelchair frame below the last horizontal tube by a pair of elastic bands connected at their upper ends to opposite ends of the last horizontal tube and at their lower ends to points on the corresponding side of the wheelchair frame below the last horizontal tube.

24. The manual wheelchair of claim 23, further comprising a seat lift assist device, wherein the seat lift assist device includes:

a. a seat board inserted into a pocket attached to the fabric adjacent to the closed loop around the first horizontal tube; and b. a release to restrain a rear edge of the seat board from upward motion;

wherein the seat lift assist device is configured to function such that when the release is released, the fabric applies an upward force to the rear edge of the seat board.

25. The manual wheelchair of claim 23, further comprising a seat elevation device configured to lift a seat board upward, wherein the seat elevation device includes:

a. a seat board inserted into a pocket attached to the fabric adjacent to the closed loop around the first horizontal tube; and b. a plurality of elastic bands, two of the elastic bands being connected each one between a front corner of the seat board and a corresponding upper end of the slide tube, wherein the seat lift elevation device is configured to function such that when the first horizontal tube is detached from the wheelchair frame, the fabric applies an upward force to a rear edge of the seat board and the two front elastic bands apply an upward force to a front edge of the seat board.

* * * * *